US010240742B2

(12) United States Patent
Kratoska

(10) Patent No.: US 10,240,742 B2
(45) Date of Patent: Mar. 26, 2019

(54) VEHICLE LIGHTING AND SIGNALING DEVICE HAVING A LENS WITH AT LEAST ONE COUPLER

(71) Applicant: Valeo North America, Inc., Seymour, IN (US)

(72) Inventor: Michael Jason Kratoska, Seymour, IN (US)

(73) Assignee: VALEO NORTH AMERICA, INC., Seymour, IN (US)

( * ) Notice: Subject to any disclaimer, the term of this patent is extended or adjusted under 35 U.S.C. 154(b) by 112 days.

(21) Appl. No.: 15/223,544

(22) Filed: Jul. 29, 2016

(65) Prior Publication Data

US 2018/0031197 A1 Feb. 1, 2018

(51) Int. Cl.

| | |
|---|---|
| ***F21S 41/27*** | (2018.01) |
| ***F21S 41/32*** | (2018.01) |
| ***F21S 41/20*** | (2018.01) |
| ***F21S 43/20*** | (2018.01) |
| ***F21S 43/239*** | (2018.01) |
| ***F21S 43/245*** | (2018.01) |

(52) U.S. Cl.

CPC ..... *F21S 41/27* (2018.01); *F21S 41/28* (2018.01); *F21S 41/322* (2018.01); *F21S 43/239* (2018.01); *F21S 43/245* (2018.01); *F21S 43/26* (2018.01)

(58) Field of Classification Search

CPC .... F21S 48/1291; F21S 48/1329; F21S 48/12; F21S 48/1241; F21S 48/1242; F21S 48/115; F21S 48/1225; F21S 48/1145; F21S 48/22; F21S 48/2225; F21S 48/2281; F21S 48/2212; F21S 41/141; F21S 41/16; F21S 41/20; F21S 41/24; F21S 41/285; F21S 43/14; F21S 43/20; F21S 43/235; F21S 43/249; F21S 43/26

See application file for complete search history.

(56) References Cited

U.S. PATENT DOCUMENTS

| | | | | |
|---|---|---|---|---|
| 6,769,798 | B2 * | 8/2004 | Mishimagi | B60Q 1/2665 362/494 |
| 8,545,070 | B2 * | 10/2013 | Sakiyama | B60Q 1/2665 362/494 |
| 2011/0013411 | A1 * | 1/2011 | Sakiyama | B60Q 1/2665 362/494 |
| 2013/0250595 | A1 * | 9/2013 | Fedosik | F21S 41/147 362/511 |
| 2016/0025291 | A1 * | 1/2016 | Iwasaki | F21S 48/1154 362/516 |

FOREIGN PATENT DOCUMENTS

DE 102010027415 1/2012

* cited by examiner

*Primary Examiner* — Bao Q Truong

(74) *Attorney, Agent, or Firm* — Oblon, McClelland, Maier & Neustadt, L.L.P.

(57) ABSTRACT

A lighting and signaling device having a lamp assembly is shown. The lamp assembly comprises a housing for supporting a head lamp and a primary light source for generating a primary light beam. The lamp assembly also includes a lens having at least one or a plurality of couplers coupled to or integrally formed in the lens. The at least one or plurality of couplers contributes light received from an at least one or a plurality of light sources to improve the light distribution pattern, such as a visibility angle of the primary light beam, which could be, for example, a signal.

20 Claims, 6 Drawing Sheets

VEHICLE LIGHTING AND SIGNALING DEVICE HAVING A LENS WITH AT LEAST ONE COUPLER

BACKGROUND OF THE INVENTION

1. Field of the Invention

This invention relates to a vehicle lighting and signaling device and an improved lens having at least one coupler for improving light distribution.

2. Description of the Related Art

In the field of motor vehicle lighting and signaling, it is increasingly commonplace to have headlamps with lenses that have curved or arcuate surfaces. One problem that designers face is the visibility regulations imposed by the regulating authorities. Sometimes it is difficult to incorporate these visibility regulations in modern lamp designs because of the outer lens rake and sweep angles as well as the functions being placed far back in the headlamp assemblies themselves. The regulatory authorities require very particular visibility angles that are difficult to achieve with the new headlamp designs. For example, some countries require a light pattern visibility of approximately 45 degrees (inboard) to 80 degrees (outboard).

It has been found that providing visibility light in a lateral and sometimes vertical direction, of the main optical axis of the headlamp, is difficult to achieve. In some prior art embodiments, the headlamp assembly included additional light sources or optics that improve the lateral and vertical visibility light. To illustrate this, FIG. 1A is a cross-sectional view of an outer lens having no modification, indicated by the arrows labeled NM. Note that the light ray, which may be a ray from a light source within the headlamp assembly, reflects off an inner surface of the lens due to the angle of incidence exceeding the critical angle according to Snell's Law. This results in decreased illumination, particularly toward the edges or corner areas of the lens.

Figure 1A:
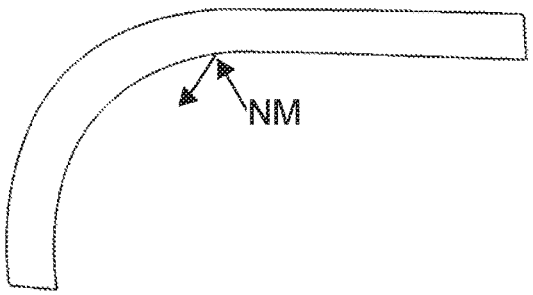
Fig. 1A Prior Art
FIG. 1B illustrates one prior art solution that includes inner lens optics and a separate light source LS that would illuminate near the edges and cooperate with the inner lens optics to provide increased lateral illumination.
FIG. 1C illustrates that some current solutions include outer lens visibility optics, such as gnoracles GN. German Patent DE 102010027415A1 shows a solution using a lens having a gnoracle.

Unfortunately, these solutions were sometimes not pleasing to designers or customers due to the uneven or, perhaps, even unlit appearance of the headlamp in the curved or edged regions of the headlamp. Space and styling of the headlamp assembly also would usually not allow for an additional lamp to improve visibility and light distribution. The additional lamp also added increased cost to the headlamp assembly and also provided unique design challenges.

What is needed, therefore, is a vehicle lighting and signaling device that overcomes one or more of the aforementioned problems.

SUMMARY OF THE INVENTION

One object of one embodiment of the invention is to provide an improved system and method for improving the visibility of a beam emitted by a light assembly.

Another object of one embodiment of the invention is to provide a lens having at least one coupler.

Another object of one embodiment of the invention is to provide a vehicle lighting and signaling device having a lens with at least one coupler.

Still another object of one embodiment of the invention is to provide an improved lamp assembly having a lens with at least one coupler.

Still another object of one embodiment of the invention is to provide a lens having a plurality of couplers.

Yet another object of one embodiment of the invention is to provide a lens having a curved or arcuate shape and that has at least one coupler that is integrally monolithically formed therein. As used herein, "integral" means consisting or composed of parts that together constitute a whole, and "monolithic" means consisting or composed of one-piece, solid or unbroken, and may comprise a common or same material, such as the materials referenced herein.

In one aspect, one embodiment of the invention comprises a lens for a lighting device for a vehicle, the lens comprising a lens body having an exit area, and at least one coupler, the at least one coupler adapted to receive light from at least one coupler light source and introduce the light into the lens body so that it can pass through the lens body and exit the exit area.

In another aspect, another embodiment of the invention comprises a lamp assembly for use on a vehicle the lamp assembly comprising at least one bezel or housing adapted to house at least one first light source for generating a first beam, the first beam being at least one of a headlamp beam, a rear lamp beam, a tail lamp beam, a lens comprising a lens body having an exit area, and at least one coupler, the at least one coupler being adapted to receive light from at least one coupler light source and introduce the light into the lens body so that it can pass through the lens body and exit the exit area, wherein the at least one coupler increases or contributes light received from the at least one coupler light source to either the first beam or a second beam in order to increase an angular visibility thereof.

In the illustrative embodiments, the at least one coupler light source and at least one light source comprise a solid state light source, such as a light emitting diode (LED), at least one filament, arc, neon or fiber optics.

This invention, including all embodiments shown and described herein, could be used alone or together and/or in combination with one or more of the features covered by one or more of the following list of features:

- The lens wherein the at least one coupler is integral with or monolithically formed in the lens body.
- The lens wherein the at least one coupler is coupled to the lens body.
- The lens wherein the lens comprises at least one edge, the at least one coupler being located at or in close proximity to the at least one edge.
- The lens wherein the at least one edge is an upper edge of the lens.
- The lens wherein the lens body has at least one deformity to facilitate distributing the light received from the at least one coupler outside the lens body.
- The lens wherein the lens comprises an upper edge and a generally opposing lower edge, the at least one coupler being located on or integrally formed at or in close proximity to the upper edge.
- The lens wherein the lens body has at least one of a texture, a prism or optics to facilitate distributing the light received from the at least one coupler outside the lens body.
- The lens wherein the coupler has an entry face and a reflective surface, the reflective surface being adapted such that an angle of incidence of light entering the entry face and encountering the reflective surface is greater than a critical angle associated with the reflective surface to facilitate total internal reflection The lens wherein the at least one coupler has a reflective coating on an outer surface thereof.

The lens wherein the lens body comprises at least one of imperfections or a coating to facilitate reflecting the light internally until it reaches the exit area whereupon it can exit the lens body.

The lens wherein the at least one coupler comprises an input surface and at least one coupler reflecting surface integral with or monolithically formed in the lens body, the at least one coupler reflecting surface by angled a predetermined angle with respect the input surface such that light from the light source with pass through the lens body generally until it reaches the exit area.

The lens wherein the predetermined angle is equal to or less than a maximum incidence angle that causes the light not to be decoupled from the lens body.

The lens wherein the at least one coupler comprises a variable cross section.

The lens wherein the variable cross section decreases from an input face of the at least one coupler toward an end of the at least one coupler.

The lens wherein the at least one coupler is integral with or monolithically formed in the lens body such that when the lens body is mounted on a headlamp assembly, the at least one coupler becomes hidden by at least one of a bezel, black shot or other structure of the headlamp assembly.

The lens wherein the at least one coupler increases or contributes the light to a primary beam of a headlamp assembly and increase an angular visibility of the primary beam. In one illustrative embodiment, the primary beam is at least one of a headlamp beam, a rear lamp beam, a signal beam or an interior lighting device.

The lens wherein the primary beam is a signal beam. In one embodiment the signal beam is a turn signal beam, which is a beam for indicating a direction a vehicle is turning.

The lens wherein the at least one coupler light source comprises at least one LED, at least one filament, arc, neon or fiber optics.

The lens wherein the lens comprises a plurality of couplers.

The lens wherein the plurality of couplers each comprise an entry face for receiving light from the at least one coupler light source, each of the plurality of couplers having a variable cross section that decreases from an entry face to an end of the coupler.

The lens wherein the lens is curved and comprises a curved edge through which light from the at least one coupler can exit the lens body.

The lens wherein the curved edge comprises at least one of texture, prism or optics.

The lens as recited in claim 1 wherein the lens is mounted on a bezel or housing adapted and configured to conceal the at least one coupler.

The lens wherein the at least one coupler is located on or integrally formed on an interior surface of the lens.

The lens wherein the at least one coupler is located on or integrally formed near an upper edge of an interior surface of the lens.

The lens wherein the lens is a headlamp lens that covers at least one of a main or primary headlamp light source for generating a headlamp beam or a signal light source for generating a signal beam, the light from the at least one coupler light source associated with the at least one coupler exits the exit area and cooperates with at least one of the headlamp beam or the signal beam to increase a visibility thereof.

The lamp assembly wherein the lens comprises a lens body having an exit area situated at a curved area of the lens the at least one coupler being integral with or monolithically formed in the lens body so that light from the at least one coupler light source can pass through the coupler and the exit area.

The lamp assembly wherein the at least one coupler has an entry face and a reflective surface, the reflective surface being adapted such that an angle of incidence of light entering the entry face and encountering the reflective surface is greater than a critical angle associated with the reflective surface to facilitate total internal reflection.

The lamp assembly wherein the at least one coupler has a reflective coating on an outer surface thereof.

The lamp assembly wherein the entry face is at an angle of about 90 degrees relative to an inner surface of the lens.

The lamp assembly wherein the lens has at least one of a texture, a prism or optics to facilitate distributing the light received from the at least one coupler outside the lens body.

The lamp assembly wherein the lens comprises at least one of imperfections or a coating to facilitate reflecting the light internally until it reaches the exit area whereupon it can exit the lens body.

The lamp assembly wherein the at least one coupler comprises an input surface and at least one coupler reflecting surface integral with the lens, the at least one coupler reflecting surface being angled a predetermined angle with respect the input surface such that light from the light source with pass through the lens and not exit the exit surface and will exit the lens when it reaches the exit area.

The lamp assembly wherein the predetermined angle is equal to or less than a maximum incidence angle that causes the light not to become decoupled from the lens.

The lamp assembly wherein the at least one coupler is integral with or monolithically formed in the lens.

The lamp assembly wherein the at least one coupler is integral with the lens body.

The lamp assembly wherein the at least one coupler is monolithically formed in the lens body.

The lamp assembly wherein the at least one coupler is coupled to the lens body.

The lamp assembly wherein the at least one coupler comprises a variable cross section.

The lamp assembly wherein the variable cross section decreases from an input face of the at least one couple toward an end of the at least one coupler.

The lamp assembly wherein the at least one coupler is integral with or monolithically formed in the lens such that when the lens is mounted on a headlamp assembly, the at least one coupler becomes hidden by at least one of the at least one bezel or the housing.

The lamp assembly wherein the at least one coupler light source comprises at least one LED, at least one filament, arc, neon or fiber optics.

The lamp assembly wherein the lens comprises a plurality of couplers.

The lamp assembly wherein the lamp assembly comprises a plurality of couplers and a plurality of coupler light sources operatively associated plurality of couplers, respectively, each of the plurality of couplers comprise an entry face for receiving light from the at plurality of coupler light sources, respectively, each of the plurality of couplers having a variable cross section that decreases from an entry face to an end of the coupler.

The lamp assembly wherein the lens comprises a curved edge through which light from the at least one coupler can exit the lens.

The lamp assembly wherein the curved edge comprises at least one of texture, prism or optics.

The lamp assembly wherein the at least one coupler is located on or integrally formed on an interior surface of the lens.

The lamp assembly wherein the light from the at least one coupler light source associated with the at least one coupler exits an exit area of the lens and cooperates with at least one of the primary beam or the signal beam to increase visibility thereof.

The lamp assembly wherein the lamp assembly is mounted on and in combination with a vehicle.

The lamp assembly wherein the lens comprises at least one edge, the at least one coupler being located at or in close proximity to the at least one edge.

The lamp assembly wherein the at least one edge is an upper edge of the lens.

The lamp assembly wherein the lens comprises an upper edge and a generally opposing lower edge, the at least one coupler being located on or integrally formed at or in close proximity to the generally opposing lower edge.

These and other objects and advantages of the invention will be apparent from the following description, the accompanying drawings and the appended claims.

BRIEF DESCRIPTION OF THE ACCOMPANYING DRAWINGS

Figure 1B:
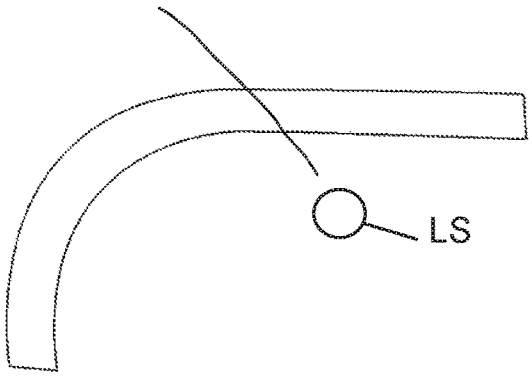
Fig. 1B Prior Art
Figure 1C:
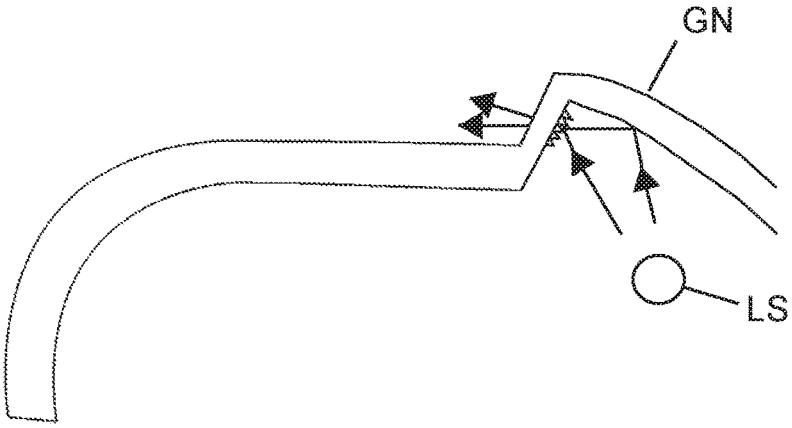
Fig. 1C Prior Art
Figure 2:
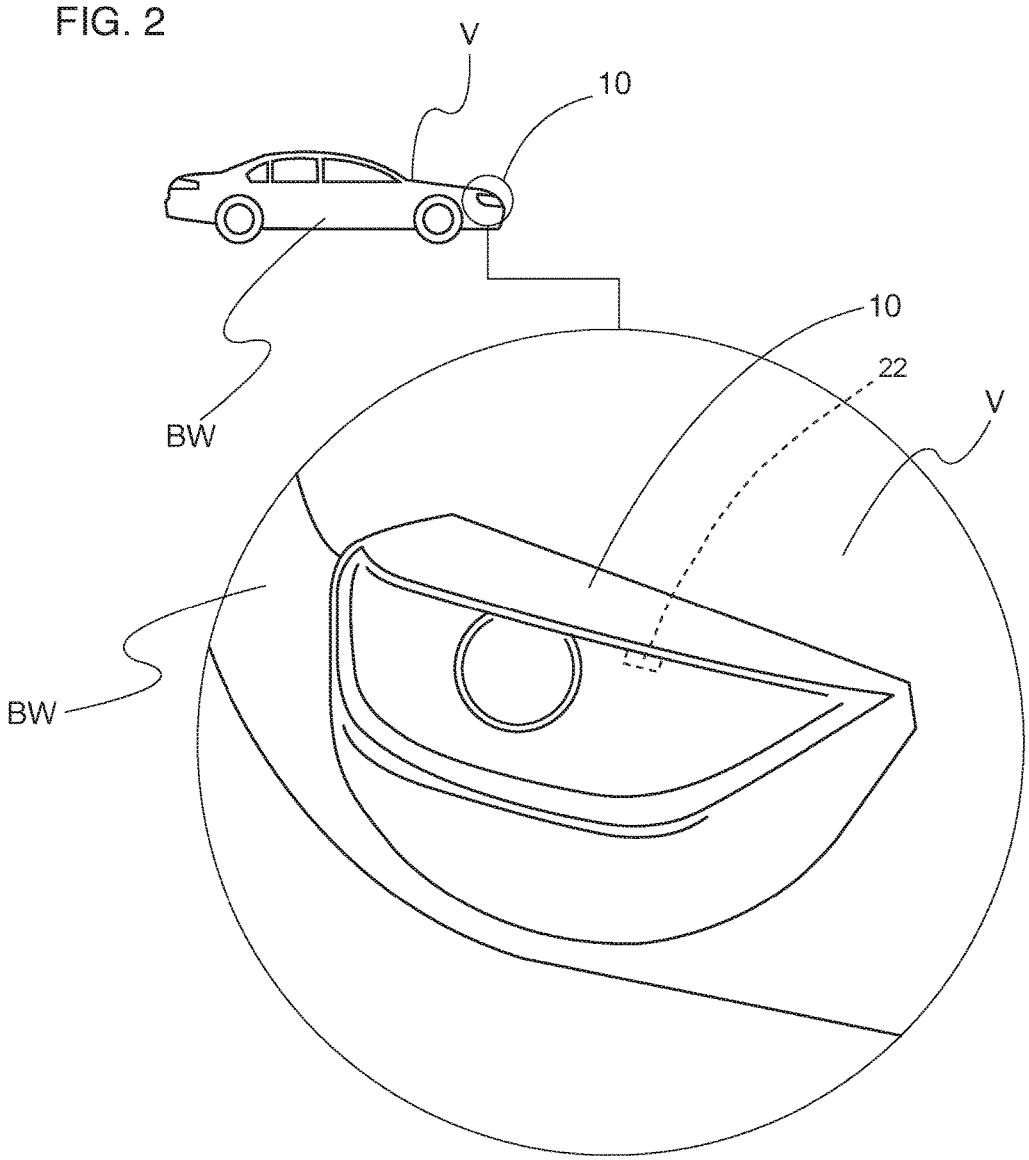
Figure 2A:
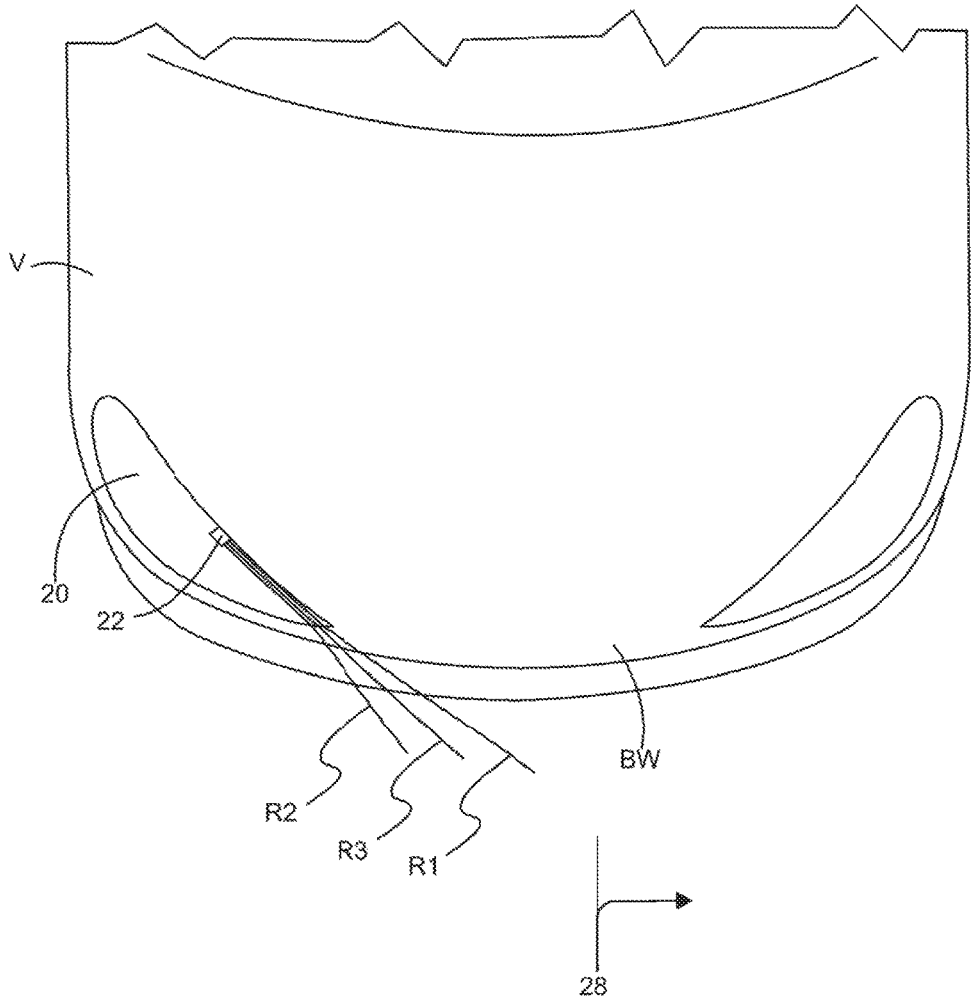
Figure 3:
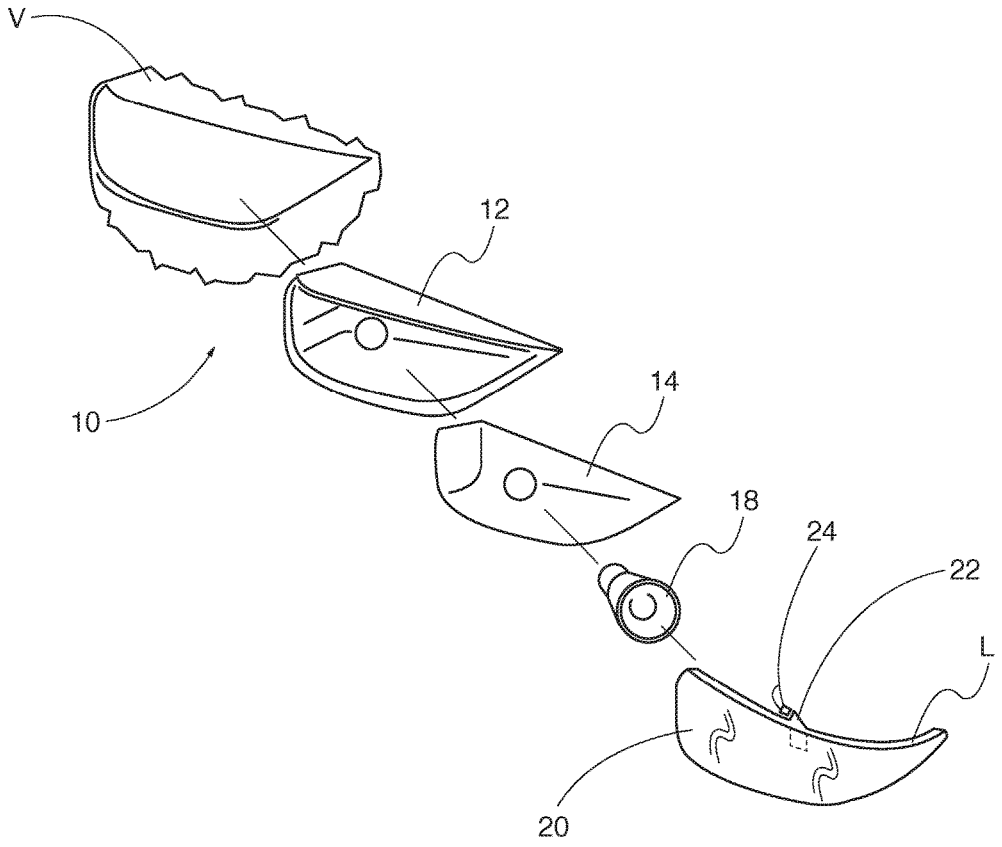
Figure 4:
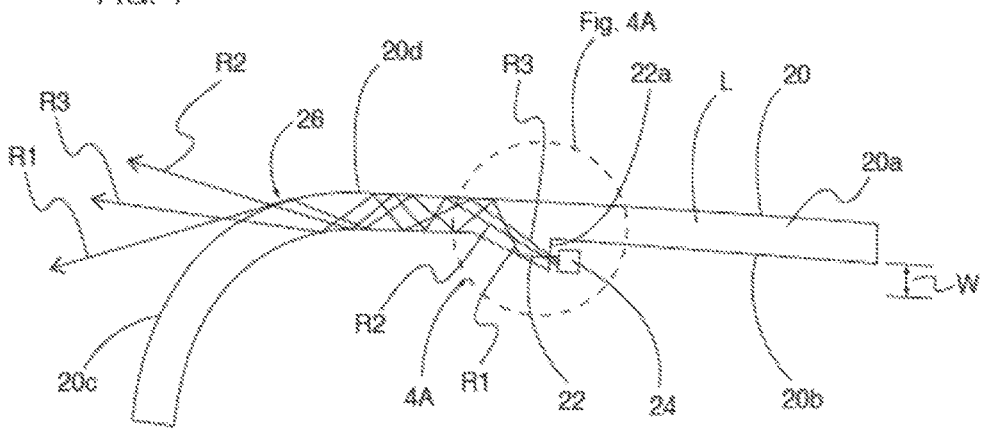
Figure 4A:
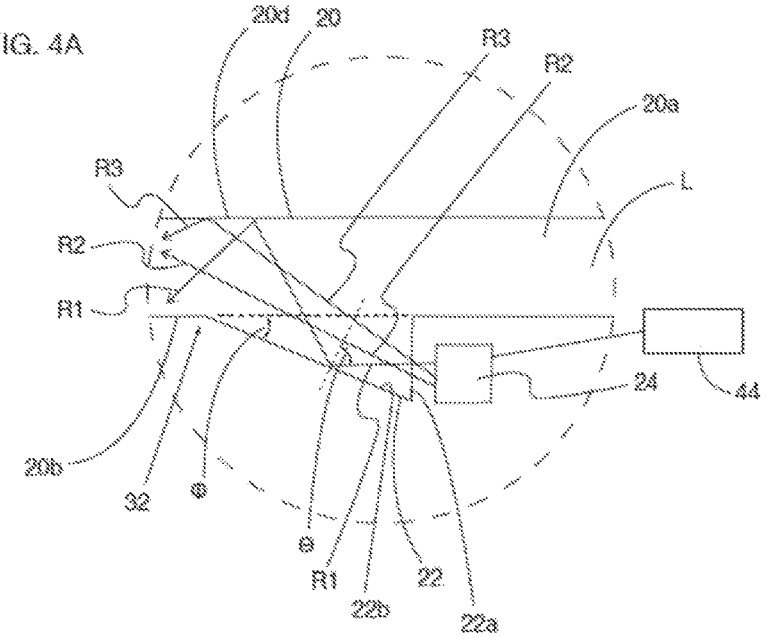
Figure 4B:
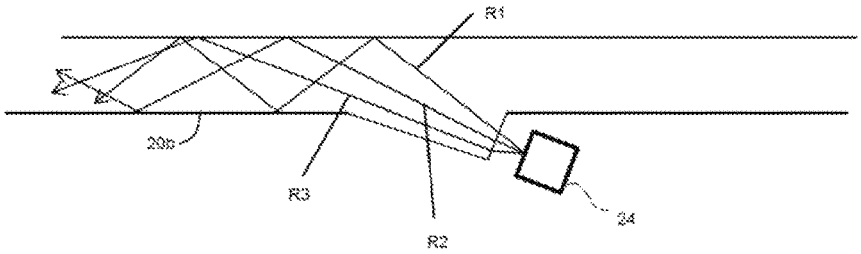
Figure 5:
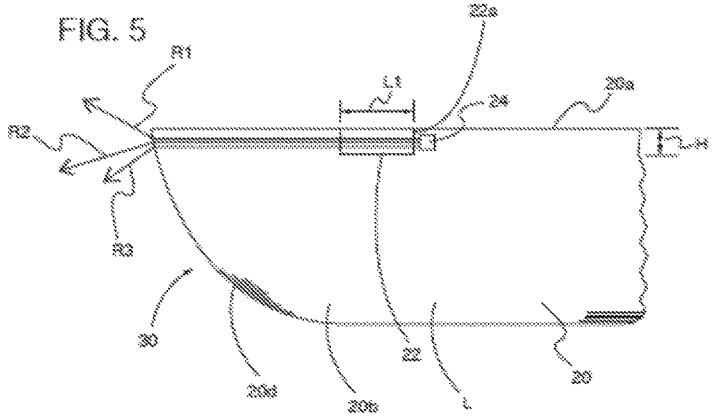
Figure 6:
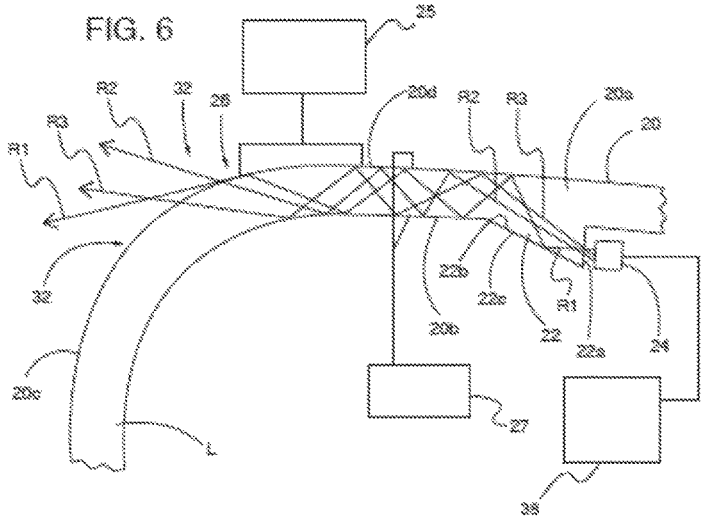
Figure 7:
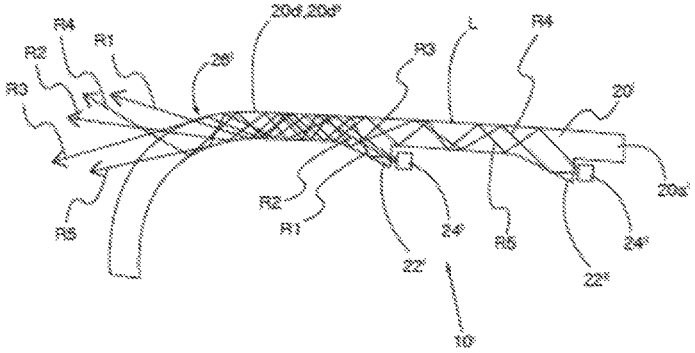

FIGS. 1A-1C are various views of prior art designs;

FIG. 2 is a view of a vehicle having a lighting and signaling device in accordance with one embodiment of the invention;

FIG. 2A is a top view of the vehicle having a lighting and signaling device in accordance with one embodiment of the invention;

FIG. 3 is an exploded view of the lighting and signaling device shown in FIG. 2 illustrating a lens in accordance with one embodiment of the invention;

FIG. 4 is a fragmentary sectional view showing the lens having a coupling in accordance with one embodiment of the invention;

FIG. 4A is an enlarged view of the circular area of FIG. 4;

FIG. 4B is another embodiment of the enlarged view of FIG. 4A showing the light source as not being perpendicular;

FIG. 5 is a view showing various details of the coupler;

FIG. 6 is an enlarged sectional view of the embodiment shown in FIG. 4; and FIG. 7 is a fragmentary sectional view illustrating a plurality of couplers in accordance with one embodiment of the invention.

DETAILED DESCRIPTION OF THE PREFERRED EMBODIMENTS

Referring now to FIGS. 2-7, a vehicle V is shown having a lighting device or lamp assembly 10 for a vehicle. The lighting device 10 may be a stylized lighting and signaling device, such as a lamp assembly, which may provide a headlamp, a tail lamp, a rear lamp, a turn signal, fog lamp, daytime running lamp or other lighting function. It should be understood that in one embodiment, the features of the invention described herein are preferably used in a headlamp assembly of the vehicle V, but these features may be used in other lamp assemblies, such as in the tail light assembly as well. For ease of illustration and description, they will be collectively referred to as a "lamp assembly".

The lamp assembly 10 comprises, for example, a housing and/or bezel 12. A reflector 14 is conventionally mounted in the housing and/or bezel 12 and at least one or a plurality of primary light sources 18 are mounted in the lamp assembly 10. For ease of illustration a single light source 18 is shown, but it should be appreciated that the lamp assembly 10 may comprise a plurality of light sources 18. It should also be understood that the at least one or plurality of light sources 18 could comprise at least one or a plurality of light-emitting diodes (LEDs), organic light-emitting diodes, laser diodes, filaments, arcs, or the like.

The lamp assembly 10 further comprises a lens L having at least one or a plurality of couplers 22 that facilitate improving the light pattern, including visibility, of the light beam distributed by the lamp assembly 10. In the illustration being described, the lens or lens body L is generally arcuate or curved. The lens or lens body 20 is monolithically or integrally formed, one-piece construction with the plurality of couplers 22 and is made from a polymer, such as polycarbonate, polymethyl methacrylate (PMMA) or a polymethacrylate material. As used herein, "integral" means consisting or composed of parts that together constitute a whole, and "monolithic" means consisting or composed of one-piece, solid or unbroken, and may comprise a common or same material, such as the materials referenced herein. In one embodiment, the lens or lens body 20 provides or defines an outer lens or cover of the lamp assembly 10 and closes the bezel or housing as illustrated in FIG. 2.

The lens or lens body 20 comprises the at least one or a plurality of couplers 22. As best shown in FIG. 4A, the plurality of couplers 22 comprise a generally planar input face 22*a*. It should be understood, that although FIG. 4A shows the at least one or plurality of light sources 18 as being perpendicular to the inner surface 20*b* of the lens or lens body 20, it does not have to be, as illustrated in FIG. 4B. At least one or a plurality of coupler light sources 24 are situated in operative relationship with the input face 22*a* as illustrated. In the embodiment being described, the at least one or plurality of light sources 24 may comprise at least one or a plurality of LEDs, laser diodes, or other type of light-emitting devices. Note that the input face 22*a* of the plurality of couplers 22 can have different measurements depending on the at least one or plurality of light sources 24 and how it is mounted. However, this size will depend on the ability to mold the plurality couplers 22, so it should be kept to a minimum. For example, a normal LED that is used today, the entrance face of the coupler would be about 3 mm in width, about 3 mm in height and about 5 mm in length.

In the embodiment being described, the at least one or plurality of couplers 22 are associated with an edge or surface, such as a top edge or surface 20*a* as explained below. In the illustration, the at least one or plurality of couplers 22 may be coupled to or integrally formed with the lens L towards the top edge or surface 20*a* of the lamp assembly 10, but it should be appreciated that it could be coupled to or integrally formed at other edges or at other areas of the lens or lens body 20, as will be described later herein. It should also be appreciated that the lens or lens body 20 may comprise the plurality of couplers 22 as illustrated in FIG. 7 that could be arranged in the same horizontal plane on the lens or lens body 20 or in different planes. Although not shown, the plurality of couplers 22 may be a separate component that is non-integral, but coupled to, adhered to or positioned in operative relationship to the lens or lens body 20.

Note that the plurality of couplers 22 are situated on or integrally formed on an inner surface 20*b* of the lens or lens body 20. One advantageous feature of this positioning is that after the lens or lens body 20 has been mounted in the lamp assembly 10, the plurality of couplers 22 become hidden by other components of the lamp assembly 10, such as by the reflector 14, housing and/or bezel 12 or even a bodywork BW of the vehicle V as illustrated in FIG. 2.

Referring now to FIG. 4A, an operation of the plurality of couplers 22 will now be described. For ease of illustration, three light rays R1, R2 and R3 are illustrated, but it should be appreciated that many more light rays would pass from the at least one or plurality of coupler light sources 24 through at least a portion of the lens or lens body 20 when the at least one or plurality of coupler light sources 24 is energized. The at least one or plurality of coupler light sources 24 generates the light rays R1, R2 and R3 which pass thought the input face 22*a*. It should be understood that at least one or plurality of coupler light sources 24 may comprise other optics 38 (FIG. 6) such as other LEDs, filaments, colored LEDs, arc, neon, fiber optics, light guide(s) or other optics in order to facilitate delivering or improving the deliverance of light from at least one or plurality of coupler light sources 24 to the plurality of couplers 22. As illustrated in FIG. 4A, the at least one or plurality of coupler light sources 24 is coupled to and under the control of an on-board light controller 44 mounted thereon and conventional powered.

The plurality of couplers 22 comprises an inner wall 22*b* that reflects the light received from the at least one or plurality of coupler light sources 24. In this regard, note that the inner wall 22*b* is angled at a predetermined angle Φ relative to an inner surface 20*b* of the lens or lens body 20. The predetermined angle Φ is selected such that a predetermined angle of incidence Θ of the rays R1, R2 and R3 relative to the inner wall 22*b* is above the critical angle according to Snell's law. This guarantees or facilitates ensuring that the light rays, such as R1-R3 from the at least one or plurality of coupler light sources 24, that encounter the inner wall 22*b* are reflected off of the inner wall 22*b* by total internal reflection. It should be appreciated that this corresponds to total internal reflection (TIR) in a preferred embodiment.

Advantageously, each of the plurality of couplers 22 are shaped and designed such that the predetermined angle θ (FIG. 4A), which is the angle between the inner wall 22*b* and the lens or lens body 20, such that light from at least one or plurality of coupler light sources 24 will be reflected off of the inner wall 22*b* and through the lens or lens body 20 by total internal reflection until it reaches the exit area 26 (FIG. 6). In order to improve the angle of incidence θ or at least facilitate ensuring this angle is greater than the critical angle, it is also possible to position at least one or plurality of coupler light sources 24 in a more advantageous or angular position relative to the surface 22*b* as illustrated in the exploded portion of FIG. 4.

Referring to FIG. 4A, note that the plurality of couplers 22 have a variable cross-section that generally decreases from the input face 22*a* toward the exit area 26. Again, the overall length L, width W and height H of the plurality of couplers 22 are adapted and dimensioned in response to the light output distribution at the exit area 26 desired, the at least one or plurality of coupler light sources 24 used, the position of the plurality of couplers 22 relative to the housing and/or bezel 12, the reflector 14, the bodywork BW of the vehicle V and the like. This is advantageous because when the plurality of couplers 22 are formed in the lens or lens body 20 as illustrated, the plurality of couplers 22 become hidden by the at least one of the housing and/or bezel 12, reflector 14, black shot, or other structure of the lamp assembly 10 or bodywork BW of the vehicle V when the lens or lens body 20 is mounted on the lamp assembly 10 or when the lamp assembly 10 is mounted on the vehicle V.

As illustrated in FIG. 2A, once the rays R1-R3 pass into the input face 22*a*, through the plurality of couplers 22 and into the lens or lens body 20, they are reflected by total internal reflection until they reach an exit area 26 of the lens or lens body 20, such as a curved or edge area, where they then exit a surface 20*c* (FIG. 4). This facilitates illuminating an area 28, light distribution visibility as illustrated in FIG. 2A.

In the illustration being described, the plurality of couplers 22 are integrally or monolithically formed in the lens or lens body 20, as mentioned earlier. While the plurality of couplers 22 are integrally formed near the top edge or surface 20*a* of the lens or lens body 20 as shown in FIGS. 4 and 5, it should be appreciated that the plurality of couplers 22 could be provided or formed near another surface, such as is shown by the surface 20*d* (FIG. 5) in the area 30 of the lens or lens body 20.

As illustrated in FIG. 6, the lens or lens body 20 may comprise at least one or a plurality of deformities 25, such as at least one texture, prism or other optics 25 or the like to improve the light distribution of the rays R1-R3 as they exit the surface 20*c* at the area 32. The lens or lens body 20 may further comprise at least one of imperfections or a coating 27 on the surface 22*c* of the plurality of couplers 22 in order to improve or facilitate the total internal reflection of the light rays R1-R3 from the at least one or plurality of light sources 24. It should also be appreciated that at least a portion of the surfaces 20*a*, 20*b*, 20*c*, 20*d*, 22*a*, 22*b*, 22*c* and 22*d* may comprise the texture, optics or a coating 27 to facilitate reflecting the light internally within the lens or lens body 20 until it reaches the exit area 26 whereupon it can exit the lens or lens body 20.

Advantageously, the embodiment being described contributes to the light output of a primary beam (not shown) generated by the primary light source 18 (FIG. 3) in order to provide an improved or desired beam pattern, such as increasing an angular visibility of the primary beam. In one illustration, the primary beam may be a signal beam or headlamp beam.

Again, it is important to note that once the lens or lens body 20 is mounted on the lamp assembly 10 and the lamp assembly 10 is mounted on the vehicle V, the plurality of couplers 22 are not visible from outside the vehicle V, as illustrated in FIG. 2.

Referring now to FIG. 7, another embodiment is shown. In this embodiment, like parts are identified with the same part numbers, except that a prime mark ("') or a double prime ("") mark has been added to the part numbers for clarity. In this embodiment, the lens or lens body 20' comprises a plurality of couplers 22' and 22" and a plurality of coupler light sources 24' and 24", respectively, that are coupled to and under the control of the light controller 44 (FIG. 4A). Advantageously, this embodiment provides additional light to the exit area 26' to facilitate improving the light distribution and the light distribution visibility provided by the lamp assembly 10'. As mentioned earlier, the plurality of couplers 22' and 22" could be situated relative to the edge 20*a*', but one or more of them could be situated relative to the other surfaces, such as surface 20*d*.

This invention, including all embodiments shown and described herein, could be used alone or together and/or in combination with one or more of the features covered by one or more of the claims set forth herein, including but not limited to one or more of the features or steps mentioned in the Summary of the Invention and the Claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A lens for a lighting device for a vehicle, said lens comprising:

a lens body having an exit area, said lens body adapted to cover a primary light source associated with one of a headlamp, a rear lamp, and a tail lamp; and at least one coupler including an input face and adapted to receive light from at least one coupler light source, different from the primary light source, and introduce said light into said lens body so that said light passes through said lens body and exits said exit area, the input face facing an exit face of the coupler light source, wherein said at least one coupler comprises a variable cross section that decreases from said input face of said at least one coupler toward said exit area of said lens body.

2. The lens as recited in claim 1, wherein said at least one coupler is monolithically formed in said lens body.

3. The lens as recited in claim 1, wherein said lens comprises at least one edge, said at least one coupler being located at or in close proximity to said at least one edge.

4. The lens as recited in claim 3, wherein said at least one edge is an upper edge of said lens.

5. The lens as recited in claim 1, wherein said lens body has at least one deformity to facilitate distributing said light received from said at least one coupler outside said lens body.

6. The lens as recited in claim 1, wherein said at least one coupler including the input face and a reflective surface, said reflective surface being adapted such that an angle of incidence of light entering said input face and encountering said reflective surface is greater than a critical angle associated with said reflective surface to facilitate total internal reflection.

7. The lens as recited in claim 1, wherein said lens body comprises at least one of imperfections or a coating to facilitate reflecting said light internally until said light reaches said exit area whereupon said light exits said lens body.

8. The lens as recited in claim 1, wherein said at least one coupler is integrally formed at an edge of the lens body.

9. The lens as recited in claim 1, wherein said at least one coupler is located on an edge of the lens body and is non-integral to the lens body.

10. The lens as recited in claim 1, wherein said at least one coupler increases or contributes said light to a primary beam of a headlamp assembly and increases an angular visibility of said primary beam.

11. The lens as recited in claim 10, wherein said primary beam is a signal beam.

12. The lens as recited in claim 1, wherein said at least one coupler light source comprises at least one solid state light source, and said at least one coupler is perpendicular to an inner surface of the lens body.

13. The lens as recited in claim 1, wherein said lens comprises a plurality of couplers, each of said plurality of couplers being configured to receive light from a plurality of coupler light sources, respectively.

14. The lens as recited in claim 1, wherein said lens is curved and comprises a curved edge through which light from said at least one coupler exits said lens body.

15. The lens as recited in claim 1, wherein said lens is mounted on a bezel or housing adapted and configured to conceal said at least one coupler.

16. A lamp assembly for use on a vehicle, said lamp assembly comprising:

at least one bezel or housing adapted to house at least one first light source associated with one of a headlamp, a rear lamp, and a tail lamp for generating a first beam; and a lens comprising:

a lens body having an exit area, said lens body adapted to cover the first light source associated with the one of the headlamp, the rear lamp, and the tail lamp, and at least one coupler including an input face and adapted to receive light from at least one coupler light source, different from the first light source, and introduce said light into said lens body so that said light passes through said lens body and exits said exit area, the input face facing an exit face of the coupler light source, wherein said at least one coupler comprises a variable cross section that decreases from said input face of said at least one coupler toward said exit area of said lens body, and said at least one coupler increases or contributes light received from said at least one coupler light source to said first beam in order to increase an angular visibility thereof.

17. The lamp assembly as recited in claim 16, wherein said first light source is associated with the tail lamp, and said first beam is a tail lamp beam.

18. The lamp assembly as recited in claim 16, wherein said lens comprises at least one edge, said at least one coupler being located at or in close proximity to said at least one edge.

19. The lamp assembly as recited in claim 16, wherein the lamp assembly is mounted on and in combination with a vehicle.

20. The lamp assembly as recited in claim 16, wherein said lens comprises an upper edge and a generally opposing lower edge, said at least one coupler being located on or integrally formed at or in close proximity to said generally opposing lower edge.

* * * * *